US005651189A

United States Patent [19]

Coykendall et al.

[11] Patent Number: 5,651,189

[45] Date of Patent: Jul. 29, 1997

[54] PORTABLE DRYING SYSTEM

[75] Inventors: Daniel A. Coykendall, Garland; Barbara Davis Reynolds, Dallas, both of Tex.

[73] Assignee: Bodi-Blo, Inc., Dallas, Tex.

[21] Appl. No.: 387,288

[22] Filed: Feb. 10, 1995

[51] Int. Cl.[6] ..... F26B 19/00

[52] U.S. Cl. ..... 34/90; 34/91; 392/380; 392/381

[58] Field of Search ..... 34/90, 91, 233, 34/97, 225, 553; 392/380, 381

[56] References Cited

U.S. PATENT DOCUMENTS

| | | | |
|---|---|---|---|
| 3,878,621 | 4/1975 | Duerre | 34/90 |
| 4,857,705 | 8/1989 | Blevins | 392/381 |
| 4,934,069 | 6/1990 | Kägi | 34/97 |
| 5,007,182 | 4/1991 | Fishman et al. | 34/90 |
| 5,377,424 | 1/1995 | Albanes | 392/381 |

FOREIGN PATENT DOCUMENTS

| | | | |
|---|---|---|---|
| 2249263 | 5/1992 | United Kingdom | 34/90 |

*Primary Examiner*—John M. Sollecito
*Assistant Examiner*—Steve Gravini
*Attorney, Agent, or Firm*—Jenkens & Gilchrist, P.C.

[57] ABSTRACT

A system for drying a large object, such as the human body, in an effective and sanitary manner. The system comprises a blower secured in a housing constructed with a plenum assembly having a decreasing volumetric configuration for diffusing and projecting a sheet of air in a select direction at a relatively uniform velocity. The air is filtered before passing through the blower and is heated for the comfort of the user. In this manner a person can utilize the sanitary benefit of warm air drying instead of towels and the like.

22 Claims, 2 Drawing Sheets

PORTABLE DRYING SYSTEM

BACKGROUND OF THE INVENTION

1. Field of the Invention

The present invention relates to blower assemblies, and more particularly to a portable, upstanding, filtering blower assembly for use in drying the human body.

2. History of the Related Art

The use of air drying systems for drying objects and individuals has been common for decades. These systems include industrial dryers of the type typically seen in carwashes as well as smaller, personal hair dryers of the hand-held variety. Hair dryers typically comprise hand-held structures housing a motor that powers a fan for driving air over a heating coil and permitting the discharge of warm air therefrom. The hand held units are generally effective for sending a column of warm air into the hair of the user for removing moisture therefrom. Similarly, industrial dryers discharge high volumes of air of varying temperatures over or through the objects being dried. The manner in which moisture is removed is well-known. The moisture which is present on the object, such as strands of hair, is met by the relatively high velocity air which causes the moisture to pass into a vapor phase and evaporate. This is equally true of small strands of hair and large automobiles. The moisture is evaporated in one phase by causing it to form a thin meniscus on the object being dried. The meniscus is exposed to the dry air and evaporates by way of partial pressure differentials. This evaporation phenomenon has been utilized and proven quite effective for commercial and residential dryers for many decades.

In many instances the drying of hair is directly associated with bathing of the human body. Hair is often washed while showering. Typically, the hand held hair dryers are not used for the human body because of the larger surface area and the non-uniform drying of the body with such a small column of air. Notwithstanding the above, the usefulness of hair drying is well-recognized. It is more sanitary and oftentimes more comfortable than towels. Sanitary conditions and personal hygiene are, in current times, a very critical issue because diseases can be transmitted by bodily fluids. Studies have shown that the germs present in a towel after drying of the human body can be significant and must be considered in hospitals and the like. Individuals who are likewise concerned about sanitary conditions, cleanliness and personal hygiene may also find the usefulness of warm air drying to be an advantage. For this reason, blowers have been developed for drying the entire human body.

U.S. Pat. Nos. 4,594,797, 4,756,094 and 4,685,222 all relate to air towels. The blowers therein utilize forced air produced in a chamber that has an elongate output port. The forced air is often heated for the comfort of the user affording a sanitary means for drying the human body without towels. While advantageous in the advance over the prior art, these patents further manifest the need for improved drying systems in today's health conscious, mobil environment. It would be an advantage, therefore, to provide a body drying unit that is portable and may be installed in both residential bathrooms as well as commercial locker rooms, such as health clubs, golf courses and the like for the convenience of those who have showered. In this manner, the major use of towels may be eliminated with sanitary improvements in the shower or locker room operation. It would likewise be an advantage to have a free-standing blower unit which does not require separate wall mountings and/or other building modifications, such as in shower areas for the use thereof. Such a system would have to be safe, reliable, convenient and portable.

The present invention provides such an advance over the prior art by providing a portable, air filtering drying unit that may be positioned on any of a variety of surfaces for the discharge of temperature controlled air in a large, uniform stream. The unit is constructed with a decreasing volumetric plenum configuration for stabilizing uniform air flow in a safe and reliable fashion.

SUMMARY OF THE INVENTION

The present invention relates to forced air drying systems particularly adapted for the human body. More particularly, one aspect of the present invention comprises an upstanding forced air drying system incorporating an air blower, a plenum assembly having a decreasing volumetric configuration adapted for receiving the diffused air and increasing the discharge velocity thereof through an elongate discharge aperture formed therein. In one embodiment, a tapered plenum is constructed with an elongate slotted section disposed in generally parallel spaced relationship with the axis of a diffuser plenum. The upper region of the discharge aperture includes a throttling plate adapted for pressurizing the plenum to cause the air therefrom to be discharged therefrom with a uniform flow pattern and velocity.

In another aspect, the plenums of the above described invention include a decreasing volumetric shape with the diffuser plenum having a generally rectangular cross-section. The blower comprises a squirrel cage fan adapted for discharging air therefrom into the diffuser plenum. The housing may further include a filter disposed in flow communication with the blower for filtering air passing therethrough and a heating unit for warming the air discharged from the housing. The heating unit may comprise an electrical resistance heating element disposed adjacent to the diffuser plenum.

In yet another aspect, the above described invention includes a housing constructed with a pyramid shape. The pyramid shaped housing includes three triangular sides and a generally triangular base from which the sides upstand. A triangularly shaped filter may then be disposed adjacent the air blower in flow communication therewith for filtering the air flow therethrough. The air blower may comprise a squirrel cage fan and the triangular filter may comprise an air permeable portion of a rear region of the housing for facilitating the ingress of air therethrough and the filtration thereof before discharge from the housing. The air blower may be of the electrical motor variety and of the type which produces an EMF, the blower being disposed in the region of the housing most remote to and distant from the opening and a user standing adjacent thereto, whereby the exposure of the user to the EMF of the motor is minimized.

In a further aspect, the present invention includes a method for forced air drying of the body of a user comprising the steps of providing an air blower and securing it within a housing wherein a diffuser plenum with a decreasing volumetric configuration has been formed in direct flow communication therewith. A second, tapered plenum is constructed with angulated side walls in a decreasing volumetric configuration having an aperture formed between the side walls for the discharge of air therefrom. The second tapered plenum is secured in flow communication with the diffuser plenum within the housing and oriented relative thereto for discharge of drying air therefrom. The housing is supported in an upstanding position relative to a user, against which air from the housing is blown.

In yet a further aspect, the above described method further includes the step of forming the second tapered plenum with a throttle plate and positioning the plate in an upper region of the aperture for throttling the airflow therethrough. The method further includes the steps of providing a filter for the air flow through the plenum and securing the filter in the housing in flow communication with the blower. A heating unit is provided for warming the air discharged from the housing. In one embodiment the heating unit is secured adjacent the diffuser plenum. The heating unit may comprise an electrical heating element.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
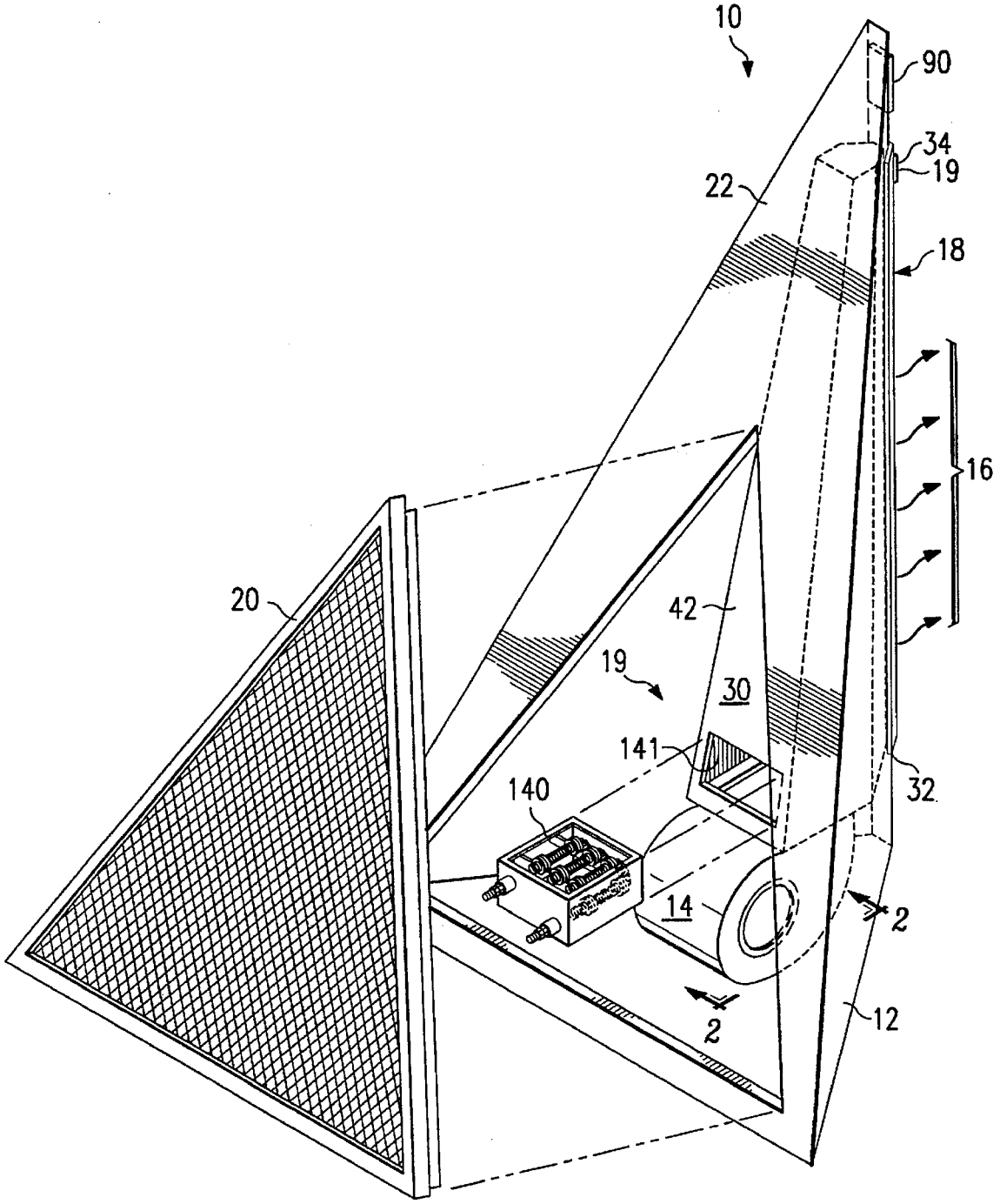
FIG. 1 is an exploded, perspective view of drying apparatus constructed in accordance with the principles of the present invention.

Referring first to FIG. 1 there is shown an exploded, perspective view of a forced air drying system 10 constructed in accordance with the principles of the present invention. System 10 comprises a housing 12 having a blower 14 secured therein for discharging air 16 through a slotted aperture 18 formed on the frontal portion thereof. A throttle plate 19 is disposed in slotted aperture 18 to promote the flow of air through the aperture at a generally uniform velocity and in an elongate pattern suitable for drying the entire human body.

Still referring to FIG. 1, the flow of air through the discharge aperture 18 is provided by a blower 14 that is assembled in the lower region of the housing 12. The blower 14 is preferably powered by an electric motor of the 110 V or 220 V variety. The blower 14 may also be of the squirrel cage variety. An electro-static filter 20 is disposed outwardly of the blower in a housing portion 22. The electrostatic filter 20 is disposed against the housing portion 22 to remove dust, dirt, and other particles from the air 16 before its introduction into the blower 14. Other filter types may, of course, be used. In this manner, air 16 processed through the system 10 is filtered to improve the cleanliness thereof. The filter 20 is an electrostatic grid for removing extremely small particles therefrom by an electrostatic process.

Referring still to FIG. 1, the blower 14 is coupled to a first plenum 30 which is formed against a second, tapered plenum 32. Each plenum is constructed in a decreasing volumetric configuration. In other words, the plenums 30 and 32 are constructed to be smaller in size and volume at the top than at the bottom for purposes of air pressure equalization and airflow stabilization across discharge aperture 18. The decreasing volumetric plenums 30 and 32 then form a plenum assembly 34 particularly adapted for a select blower air flow and which is secured within housing 12 in flow communication with aperture 18. A heating unit 140 is shown installed in a slot 141 disposed in lower region 42 of plenum assembly 34. The heating unit 140 is sized to generate sufficient heat for the comfort of the user.

Still referring to FIG. 1, the triangular filter 20 is secured in the planar back panel of the housing 12. It may be seen that the filter 20 is disposed adjacent the blower 14 for providing a means of ingress of air thereto, which means of ingress affords a filtration process consistent with the principles of the present invention. There is also shown a control panel 40 disposed on a front side of housing 12, which panel 40 may also control the activation of the electrostatic charge across the filter 20 as well as the blower 14.

Figure 2:
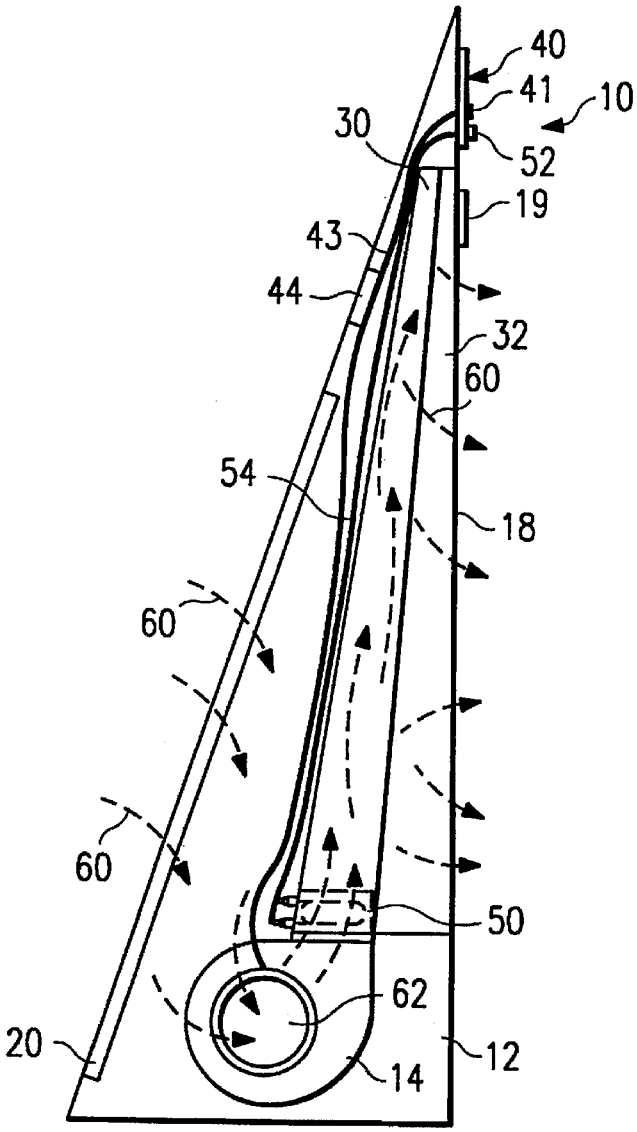
FIG. 2 is a diagrammatic, side elevational view of the drying apparatus of FIG. 1 taken along the lines 2—2 thereof and illustrating the flow of air therefrom.

Referring now to FIG. 2 there is shown a diagrammatic, side elevational view of the system 10 of FIG. 1. In this particular view, the decreasing volumetric shape of first and second plenums 30 and 32 is more clearly shown. First plenum 30 has a generally rectangular cross-section which tapers downwardly in size. The plenum 30 is positioned in direct flow communication with the blower 14. Air driven from the blower 14 flows into the first plenum 30, where it passes into the second tapered plenum 32 where it is accelerated in speed due to the angulated walls thereof. The aperture 18 formed between the angulated walls serves as a discharge port for the rapid air movement. By placing the throttle plate 19 in the top of the discharge aperture 18, resistance to the upper discharge of air from the blower 14 is provided in conjunction with the decreasing volumetric configuration of the plenums 30 and 32. This construction ensures a more uniform discharge of air from the system 10. The width of the aperture 18 is established by determining the volume of air introduced. An aperture having a width of 4 inches has been found to be suitable for discharging air at a velocity of on the order of 55 mph to thereby provide a drying effect for an wet object such as a human body standing approximately 3 feet therefrom. The velocity of the air and the decreased partial pressure of the moisture in contact therewith, by virtue of the movement thereover, provides evaporative drying in a clean and effective manner.

Still referring to FIG. 2, it may be seen that a control panel 40 is provided with a switch 41 on the surface thereof. The control panel is connected by wires 43 to a timer 44 in controlling the blower 14. The timer 44 permits a single actuation of the switch to produce a preselect duration of blowing air for the drying of the human body. In some instances, a heating element 50 may be utilized as shown in phantom which heating element 50 is used to heat the air to a more comfortable level. A switch 52 mounted to control panel 40 is connected to the heating element 50 by wire 54 for control thereof. A thermostat and/or timer (not shown) may also be used therewith.

Figure 3:
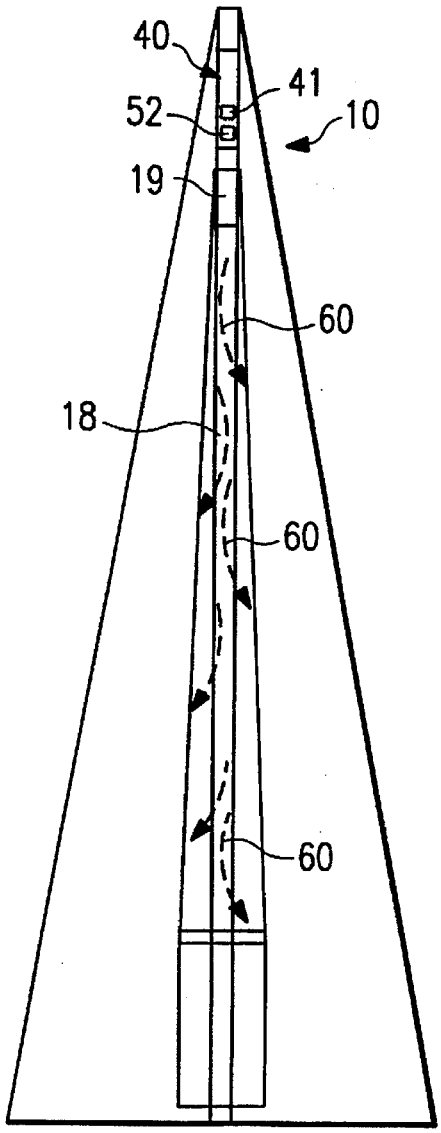
FIG. 3 is a front elevational view of the drying apparatus of FIG. 2.

Referring still to FIG. 2, there is shown a diagrammatic illustration of the flow pattern of air through the housing 12. It may be seen that the air 60 passes in a downward direction through the filter 20 into the intake manifold 62 of the blower 14 and outwardly of the blower through the above-described first and second plenum sections. In the first plenum section 30, the air 60 flows in a generally upwardly direction, increasing the air pressure thereacross. In the second plenum 32, the air 60 is generally outwardly directed to pass through the slotted discharge aperture 18 of the housing 12. Referring now to FIG. 3, there is shown a front elevational view of the drying apparatus of FIG. 2. In this particular view, the throttle plate 19 is shown atop the discharge aperture 18 with the control panel 40 and switch 41 also shown.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. A forced air drying system for removing moisture from a user comprising:

housing;

an air blower secured within fixed region of said housing;

a first plenum having a decreasing volumetric configuration secured within said housing adapted for receiving the discharge of air from said blower;

a second plenum disposed in flow communication with said first plenum having a decreasing volumetric configuration, said second plenum having angulated side walls terminating in an opening formed therebetween for the discharge of air therefrom;

said first plenum having an elongate, generally rectangular cross-sectional configuration of decreasing volumetric size along the length thereof for said air discharge reception and airflow momentum diffusion thereof; and support means for facilitating the upstanding positioning of said housing relative to a user; and a throttle plate secured in said opening for throttling the flow of air therethrough.

2. The apparatus as set forth in claim 1 wherein said blower comprises a squirrel cage fan adapted for discharging air therefrom into said first plenum.

3. The apparatus as set forth in claim 1 wherein said housing further includes a filter disposed in flow communication with said blower for filtering air passing therethrough.

4. The apparatus as set forth in claim 3 wherein said filter is of the electrostatic variety.

5. The apparatus as set forth in claim 1 and further including a heating unit for warming the air discharged from said housing.

6. The apparatus as set forth in claim 5 wherein said heating unit comprises an electrical resistance heating element disposed adjacent to said first plenum.

7. The apparatus as set forth in claim 1 wherein said housing is constructed with a pyramid shape.

8. The apparatus as set forth in claim 7 wherein said pyramid shaped housing includes three triangular sides and a generally triangular base from which said sides upstand.

9. The apparatus as set forth in claim 7 and further including a triangular shaped filter disposed adjacent said air blower in flow communication therewith for filtering the air flow therethrough.

10. The apparatus as set forth in claim 9 wherein said air blower comprises a squirrel cage fan and said triangular filter comprises an air permeable portion of a rear region of said housing for facilitating the ingress of air therethrough and the filtration thereof before discharge from said housing.

11. The apparatus as set forth in claim 1 and further including control means for actuating said blower, said control means being disposed on a frontal surface of said housing in the vicinity of said opening.

12. The apparatus as set forth in claim 1 wherein said air blower is of the electrical motor variety and of the type which produces an EMF, said blower being disposed in the region of the housing most remote to and distant from said opening and a user standing adjacent thereto, whereby the exposure of the user to the EMF of the motor is minimized.

13. A method for forced air drying the body of a user comprising the steps of:

providing an air blower;

providing a housing for said air blower;

securing said blower within said housing;

forming a first plenum with a decreasing volumetric configuration;

securing said first plenum within said housing in direct flow communication with said blower for receiving discharge of air therefrom;

forming a second plenum with a decreasing volumetric configuration, angulated side walls and an opening formed between said side walls for the discharge of air therefrom;

securing said second plenum in flow communication with said first plenum and within said housing and oriented relative thereto for discharge of drying air therefrom;

supporting said housing and said decreasing volumetric plenums for facilitating the use thereof in an upstanding position relative to a user; and driving said blower to force air from said housing in the direction of the body of said user; and said step of forming said second plenum includes the step of providing a throttle plate and positioning said plate in said opening for throttling the airflow therethrough.

14. The method as set forth in claim 13 and further including the step of providing a filter for said air flow through said plenums and securing said filter in said housing in flow communication with said blower.

15. The method as set forth in claim 13 and further including the step of providing a heating unit for warming the air discharged from said housing.

16. The method as set forth in claim 15 and further including the step of securing said heating unit adjacent said first plenum.

17. The method as set forth in claim 15 wherein said heating unit comprises an electrical heating element.

18. The method as set forth in claim 13 and further including the steps of constructing said housing in a generally pyramid shape.

19. The method as set forth in claim 18 and further including forming said pyramid shape of said housing with three triangular sides and a generally triangular base and securing said sides to said base whereby said sides upstand therefrom.

20. The method as set forth in claim 19 and further including the steps of providing a filter and securing said filter adjacent said air blower in flow communication therewith.

21. The method as set forth in claim 20 and further including providing control means for actuating said blower, securing said control means on a frontal surface of said housing in the vicinity of a user positioned in the region of air discharged therefrom.

22. The method as set forth in claim 13 and further including the step of securing said air blower in the region of the housing most remote to and distant from the user whereby the exposure of the user to the EMF of the motor is minimized for safety reasons.

* * * * *

UNITED STATES PATENT AND TRADEMARK OFFICE

CERTIFICATE OF CORRECTION

PATENT NO. : 5,651,189

DATED : Jul. 29, 1997

INVENTOR(S) : Coykendall et al.

It is certified that error appears in the above-identified patent and that said Letters Patent is hereby corrected as shown below:

| | |
|---|---|
| Column 5, line 6 | Before "housing"<br>Insert --a-- |
| Column 5, line 7 | Before "fixed"<br>Insert --a-- |
| Column 6, line 10 | After "receiving"<br>Insert --the-- |

Signed and Sealed this

Thirty-first Day of March, 1998

Bruce Lehman

*Attest:*

BRUCE LEHMAN

*Attesting Officer*

*Commissioner of Patents and Trademarks*